US006896254B2

(12) United States Patent
Koh et al.

(10) Patent No.: US 6,896,254 B2
(45) Date of Patent: May 24, 2005

(54) AUTO COMPLIANT PICK ARM

(75) Inventors: Seng San Koh, Singapore (SG); Cherng Linn Teo, Singapore (SG); Pui Wen Huang, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/402,875

(22) Filed: Mar. 28, 2003

(65) Prior Publication Data

US 2004/0188917 A1 Sep. 30, 2004

(51) Int. Cl.[7] ..... B65H 3/06
(52) U.S. Cl. ..... 271/117
(58) Field of Search ..... 271/117

(56) References Cited

U.S. PATENT DOCUMENTS 5,527,026 A 6/1996 Padget
6,267,369 B1 * 7/2001 Regimbal et al. ..... 271/114
6,318,715 B1 * 11/2001 Froechte et al. ..... 271/117
6,322,065 B1 11/2001 Underwood
6,332,608 B1 * 12/2001 Tamura ..... 271/111
6,572,096 B1 * 6/2003 Johnson et al. ..... 271/25
6,736,389 B2 * 5/2004 Kosmoski ..... 271/116
2004/0046309 A1 * 3/2004 Lee et al. ..... 271/121

FOREIGN PATENT DOCUMENTS

JP 11 - 49388 * 2/1999 ..... B65H/3/06

* cited by examiner

*Primary Examiner*—Donald P. Walsh
*Assistant Examiner*—Kenneth W. Bower

(57) ABSTRACT

The invention relates to a pick arm for picking a media from a media stack. The pick arm includes a first arm section and a second arm section which are pivotally connected together. Each of the first and second arm sections have respective first and second ends. A media roller is attached to the first end of the first arm section and the second end of the second arm section is attached to drive means configured to apply a torque to the pick arm. When the applied torque is insufficient to enable the pick arm to pick up a media and drive it up a separation wall, the media roller is arranged to automatically move from a first position to a second position. The second position being located distal from the first position in a direction away from the separation wall.

13 Claims, 5 Drawing Sheets

AUTO COMPLIANT PICK ARM

FIELD OF THE INVENTION

The present invention relates to an auto compliant pick arm for picking a media from a media stack. The invention has application in any apparatus in which a single media, such as a sheet of paper or card, must be picked from a stack of media. An example of such an apparatus is a printer or photocopier.

BACKGROUND OF THE INVENTION

Conventional pick arm arrangements generally have little difficulty in picking media having low stiffness and low media to media coefficients of friction. However, when the media is stiff and/or the media to media coefficient of friction is high, the resistant force increases significantly. This problem magnifies when the pick arm is an auto compensation pick arm. U.S. Pat. No. 5,527,026 describes such a pick arm.

The resistant force in a media picking process consists of two components. The first component is the frictional force between the media being picked and an adjacent media on the media stack, which is directly proportional to the coefficient of friction (COF) between the two surfaces and the normal force applied to the media stack by the media roller. The normal force component is proportional to the applied torque at the point of time.

The second component is equal in magnitude, but opposite in direction, to the force applied by the media roller onto the media less the frictional force between media (which is the first type of resistant force mentioned above). The maximum value of this second component is the force required to buckle/curl the media up the separation wall, which is fixed for a certain geometrical set up and only varies with the type of media used. It therefore will be appreciated that it becomes much more difficult to pick the abovementioned media and drive them up the separation wall of the apparatus. Accordingly, a higher drive torque needs to be applied to the pick arm.

For a set up where the roller to wall distance is short, the resistant force is high due to the higher buckling force required to buckle the media. This problem becomes more significant for an auto compensation pick arm. As the drive torque on the auto compensation pick arm is increased, the geometry of the arrangement is such that the reaction force of the media roller on the media is also increased. With some auto compensation pick arm arrangements when faced with relatively high resistant force, the normal force component will increase significantly as compared to the drive component. This means that excessively high torque needs to be applied in order to generate a slight increase in drive force. This limits the capability of such arrangements to pick up media with high resistant force, as excessive high torque can cause part damage.

There are two common ways to resolve this problem. The first is to reduce the angle of the separation wall of the apparatus so as to allow the media to more readily ascend the separation wall. The second is to shift the media roller further away from the separation wall so that the resistant force is reduced. Both methods reduce the resistant force required to buckle/curl the media up the separation wall.

Unfortunately, when either of the above solutions is adopted a much higher frequency of multiple media pick ups occurs with low stiffness media. Thus it becomes necessary to either adjust the angle of the separation wall or to shift the media roller relative thereto depending on the nature of the media being used in the apparatus. To achieve this automatically it is necessary to have the ability to accurately and reliably detect the media type in the media tray (most likely by means of some sensors) and include a motor to change the angle of the separation wall or to move the media roller. The inclusion of such a motor results in increased apparatus costs and increased design complexity.

Another approach to resolve this problem is to spring bias the system and alter the geometry, by further stressing the spring, when certain forces in the system exceed certain predetermined values. One example of such a system uses a pick arm mounted on a movable platform which is fitted on two slider tracks. When the drive force exceeds a certain value, the platform is caused to slide to a new position where it is further away from the separation wall. By doing this, the distance between the pick roller and the separation wall is increased and thereby the buckling force is reduced. After the media is moved, the platform is returned to its original position under the action of the spring bias.

U.S. Pat. No. 6,322,065 describes a pick arm formed from an inner section and an outer section which are hinged together at a spring biased hinge axis. The end of the inner section is mounted at a pivot point. A motor mounted on the pick arm drives a pick roller mounted at the end of the outer section. During rotation of the pick roller, the media applies a resisting force to the pick roller which induces a moment at the pivot point of the inner section. When the moment exceeds the spring force, the inner and outer sections hinge at the hinge axis and rotate. The inner section rotates in a clockwise direction and the other section rotates in an anticlockwise direction. As a result, the pick roller is moved away from the separation wall.

One advantage of hinging the pick arm is that picking becomes more effective as the angle of the lower section $\alpha$ increases. This is because as the pick arm angle $\alpha$ increases, the normal force increases. Unfortunately, by increasing the normal force the device of U.S. Pat. No. 6,322,065 reduces its ability to pick "sticky media" (i.e. media with a high sheet to sheet coefficient of friction). This is a significant disadvantage.

The present invention seeks to address at least some of the problems identified above.

SUMMARY OF THE INVENTION

According to the present invention there is provided an auto compliant pick arm for picking a media from a media stack, said pick arm including at least a first arm section and a second arm section which are pivotally connected together, each of said first and second arm sections having first and second ends, a media roller attached to said first end of said first arm section, said second end of said second arm section being arranged for attachment to drive means configured to apply a torque to said pick arm and wherein when said applied torque is insufficient to enable said pick arm to pick up a media and drive it up a separation wall, said media roller is caused to move from a first position to a second position, said second position being located distal from said first position in a direction away from said separation wall.

Preferably, said second position is located away from said separation wall so that the force necessary to pick up said media and drive it up said separation wall is reduced when compared to the necessary force when the media roller is located in the first position. Accordingly, when the media roller is moved to the second position, the torque applied to the pick arm will then be sufficient to enable the media roller to pick up the media and drive it up the separation wall.

The force necessary to pick up said media and drive it up said separation wall is equivalent to sum of the buckling force required to buckle or curl the media so it can be driven up the separation wall, and the frictional force between media being picked and an adjacent media on the media stack, under the normal force applied to the media by the media roller.

Preferably, when said applied torque is insufficient to enable said pick arm to pick up said media, said first and second arm sections of the pick arm are caused to move so as to locate the media roller farther away from said separation wall. The movement of the first and second arm sections is preferably a rotation. During rotation, the first arm section is caused to rotate about the pivotal connection between the second end of the first arm section and the first end of the second arm section. The second arm section is arranged to rotate about the connection between its second end portion and a fixed pivot. The first and second arm sections are arranged to rotate in opposite directions.

Preferably, the pivotal connection between the first and second arm sections is spring biased so that the media roller can be returned to the first position once the media begins to move. The spring bias also provides a predetermined torque value at which the pick arm complies.

In one arrangement, when the media roller is in the first position the elongate axis of the first and second arm sections are coplanar.

Preferably, the location of the second position relative to the separation wall is variable.

BRIEF DESCRIPTION OF THE PREFERRED EMBODIMENTS

Embodiments of the invention will now be described, by way of example only, with reference to the accompanying drawings in which.

DETAILED DESCRIPTION OF THE PREFERRED EMBODIMENTS

Figure 1:
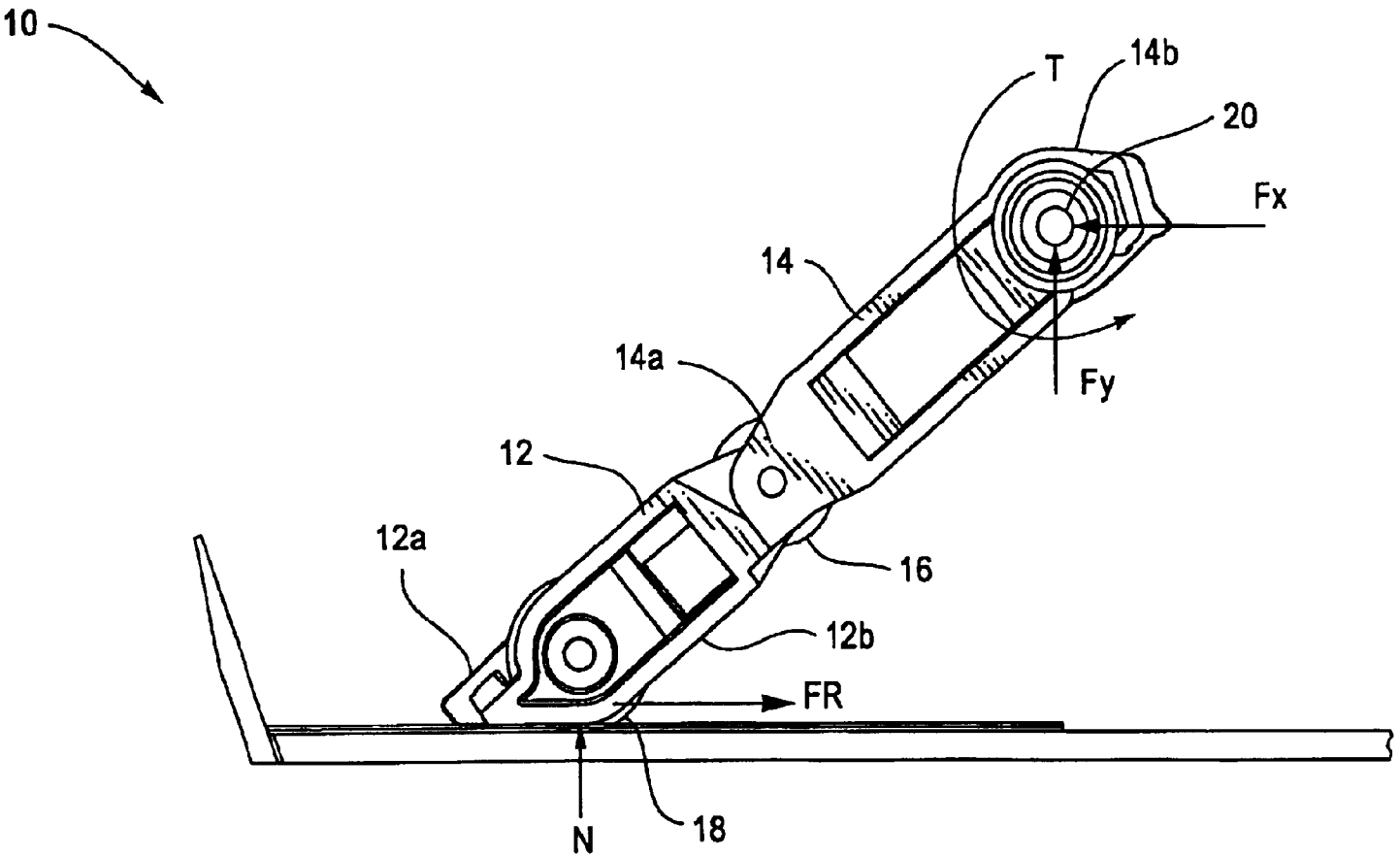
FIG. 1 is a side view of a schematic pick arm according to an embodiment of the invention in a first position and showing the forces on the pick arm during use.

FIG. 1 schematically illustrates an auto compliant pick arm 10 for picking a media from a media stack. To aid the description of the preferred embodiment the media will be referred to as a "sheet", such as a sheet of paper. However, it will be appreciated that the media may include a wide range of media from plain paper to special media such as cardboard, print film or the like.

The pick arm 10 includes a first arm section 12 and a second arm section 14 which are pivotally connected together at 16. Each of the first and second arm sections 12, 14 have respective first and second ends 12*a*, 12*b*, 14*a*, 14*b*. A media roller 18 is attached at or adjacent to the first end 12*a* of the first arm section 12. The media roller 18 is configured to contact a sheet located in a media tray and is selected to prevent slippage there between.

Figure 2:
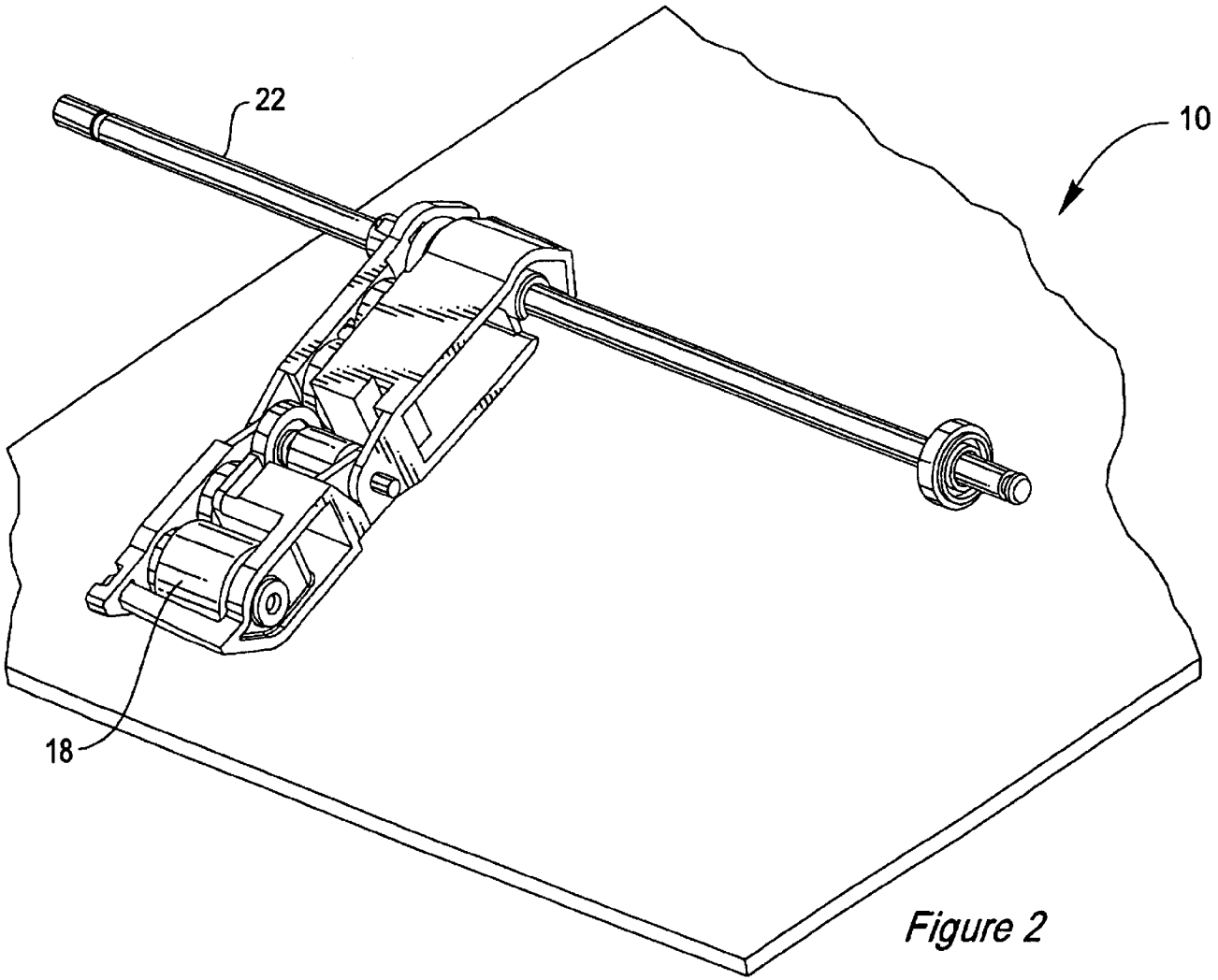
FIG. 2 is a perspective view of the pick arm show in FIG. 1.

The second end 14*b* of the second arm section 14 is mounted for pivotal movement about pivot axis 20. As shown in FIG. 2, the pivot axis 20 is a rod 22 which is connected to a printer tray or the like (not shown). The pick arm 10 is mounted on the rod 22.

The pivotal connection 16 between the first and second arm sections 12, 14 is spring loaded. The bias of the spring loaded connection is such as to bias the first and second arm sections 12, 14 to the position shown in FIG. 1.

Figure 5:
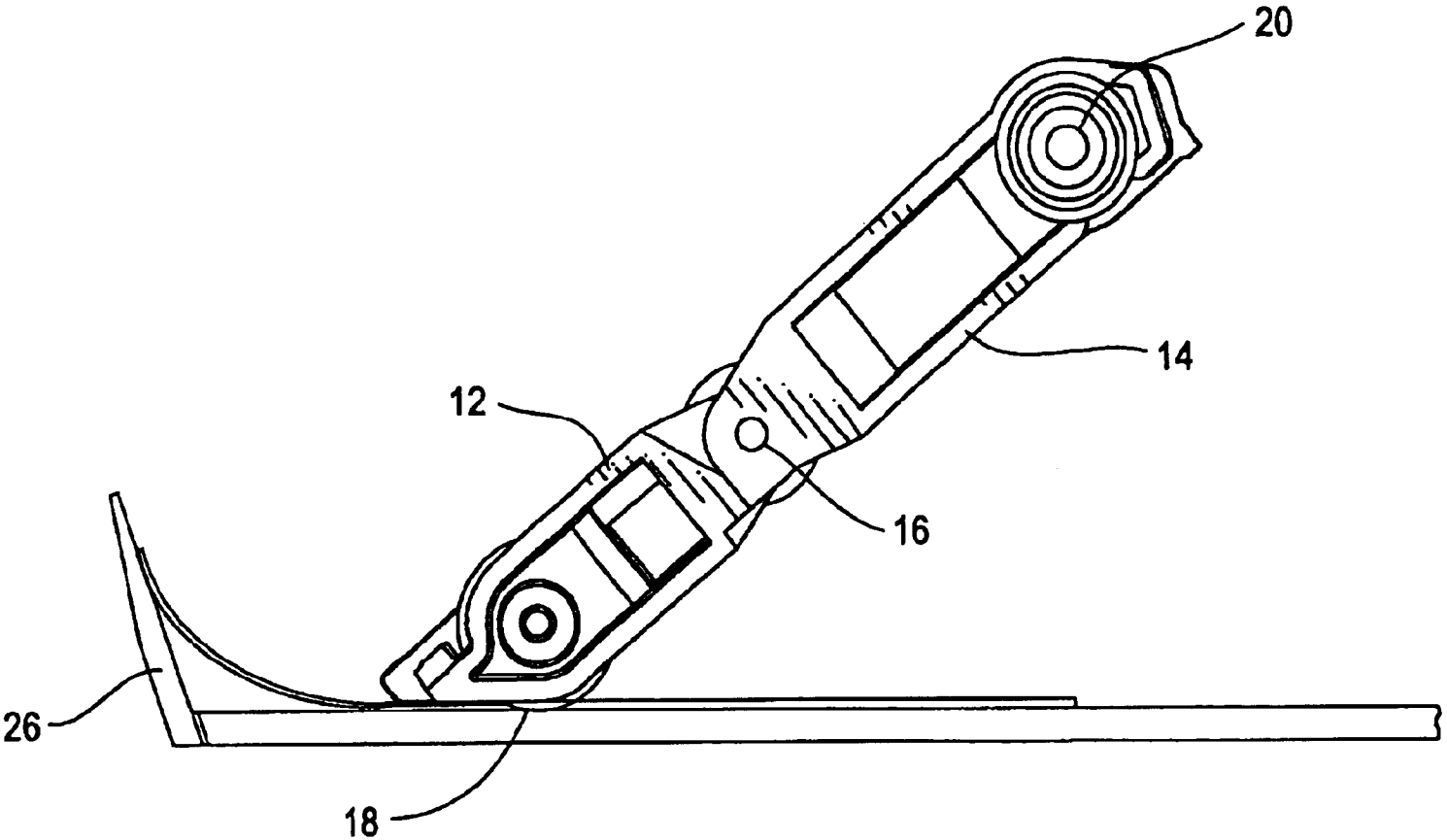
FIG. 5 is a side view of the pick arm moving a media up the separation wall.

FIG. 5 schematically illustrates the pick arm 10 mounted within a paper tray which includes a floor 24 and a separation wall 26. A number of sheets are shown on the floor 24 of the paper tray and the media roller 18 is in contact with the top sheet of the stack of sheets held in the paper tray.

During normal operation of the pick arm 10, a torque T is applied to the second end 14*b* of the second arm section 14 which results in a drive force DF being applied to the media roller 18. The torque T applied is such that the drive force DF normally enables the pick arm 10 to drive the top sheet up the separation wall 26. The drive force DF is the maximum force that the media roller 18 can provide under a given drive torque T. The drive force DF is limited by the normal force N applied by the media roller 18 and the media roller 18 to sheet coefficient of friction (COF). If the normal force N and the roller to sheet frictional force are high enough to prevent slippage of the media roller 18 under a certain torque T, the drive force DF will be equivalent to the value of the torque T divided by the radius of the media roller 18 multiplied by the value of the radius of the transmission gear on the roller over the radius of the pivotal gear at 20.

In order for the media roller 18 to be able to drive a sheet up the separation wall 26, the nett force NF applied must be greater than zero. The nett force NF is equivalent to the difference between the drive force DF and the maximum resistant force RF. The maximum resistant force RF is the sum of the forces required to buckle/curl the sheet up the separation wall 26 and the sheet to sheet frictional force created by the normal force N.

As will be appreciated by those skilled in the art, the media roller 18 is normally positioned as close as possible to the separation wall 26 to reduce the likelihood of a multi pick event. A multi pick event is where more than one sheet is picked by the media roller 18 at a time and driven up the separation wall 26. The closer the media roller 18 is positioned to the separation wall 26, the stiffer the front portion of the sheet will be. Accordingly, the force required to move more than one sheet up the separation wall 26 is increased. By locating the media roller 18 close to the separation wall 26 the likelihood of the media roller 18 having sufficient nett force NF to pick up more than one sheet is greatly reduced. It will also be appreciated by those skilled in the art that setting the separation wall 26 at a steep angle will have the same effect.

When the sheet is stiff or when there is a high sheet to sheet coefficient of friction, the pick arm 10 in accordance with an embodiment of the present invention is required to make an automatic compensation. This is achieved in the following manner.

A torque T is applied to the second end 14*b* of the section arm section 14 so as to cause the media roller 18 to drive the sheet up the separation wall 26. However, when the sheet is of high stiffness and/or the coefficient of friction between adjacent sheets is very high, the media roller 18 will have insufficient drive force DF to drive the sheet up the separation wall 26. Instead, the first and second arm sections 12, 14 will be caused to rotate about the respective pivot points 16, 20.

Figure 3:
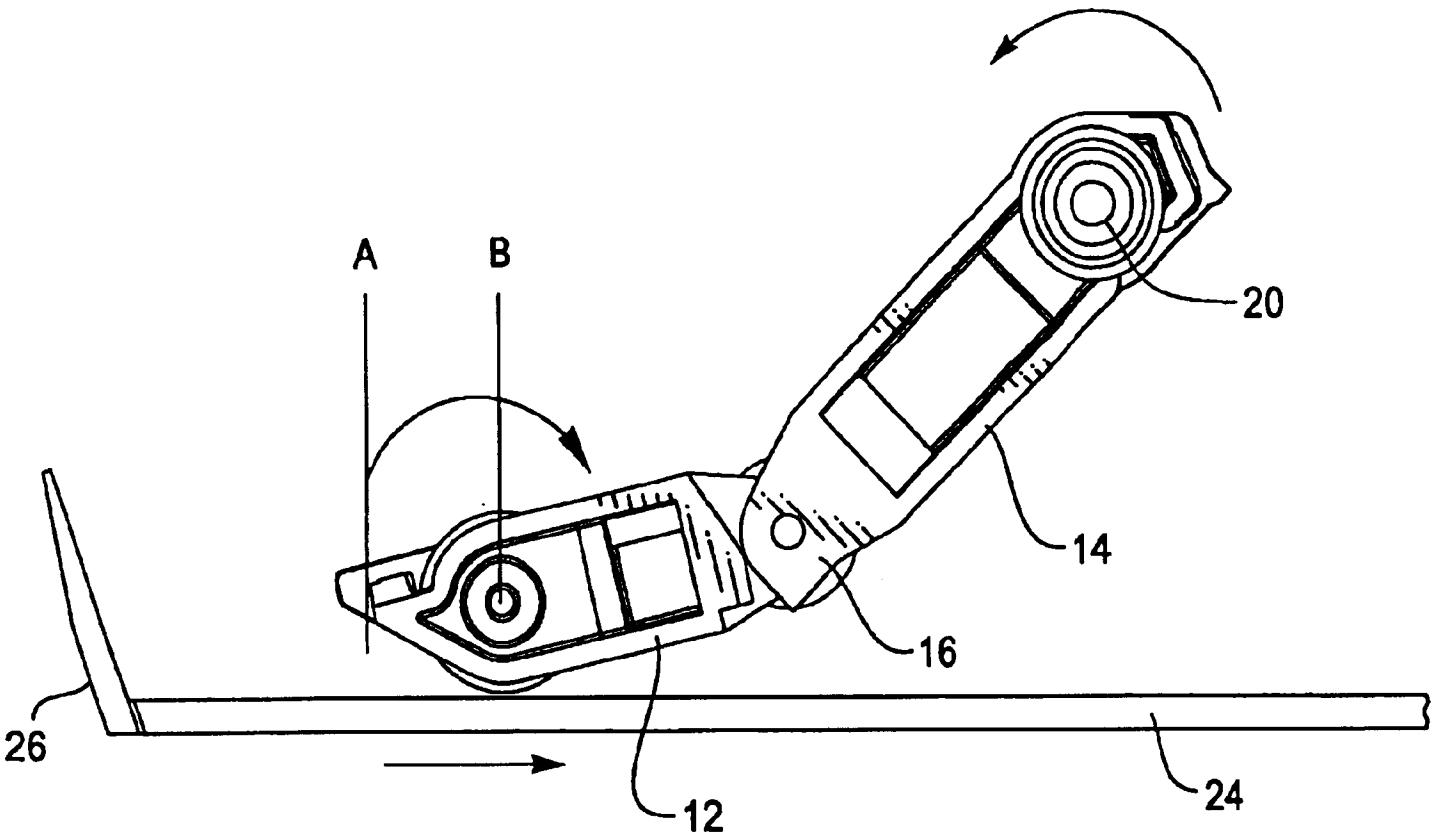
FIG. 3 is a side view of the pick arm in a second position.
Figure 4:
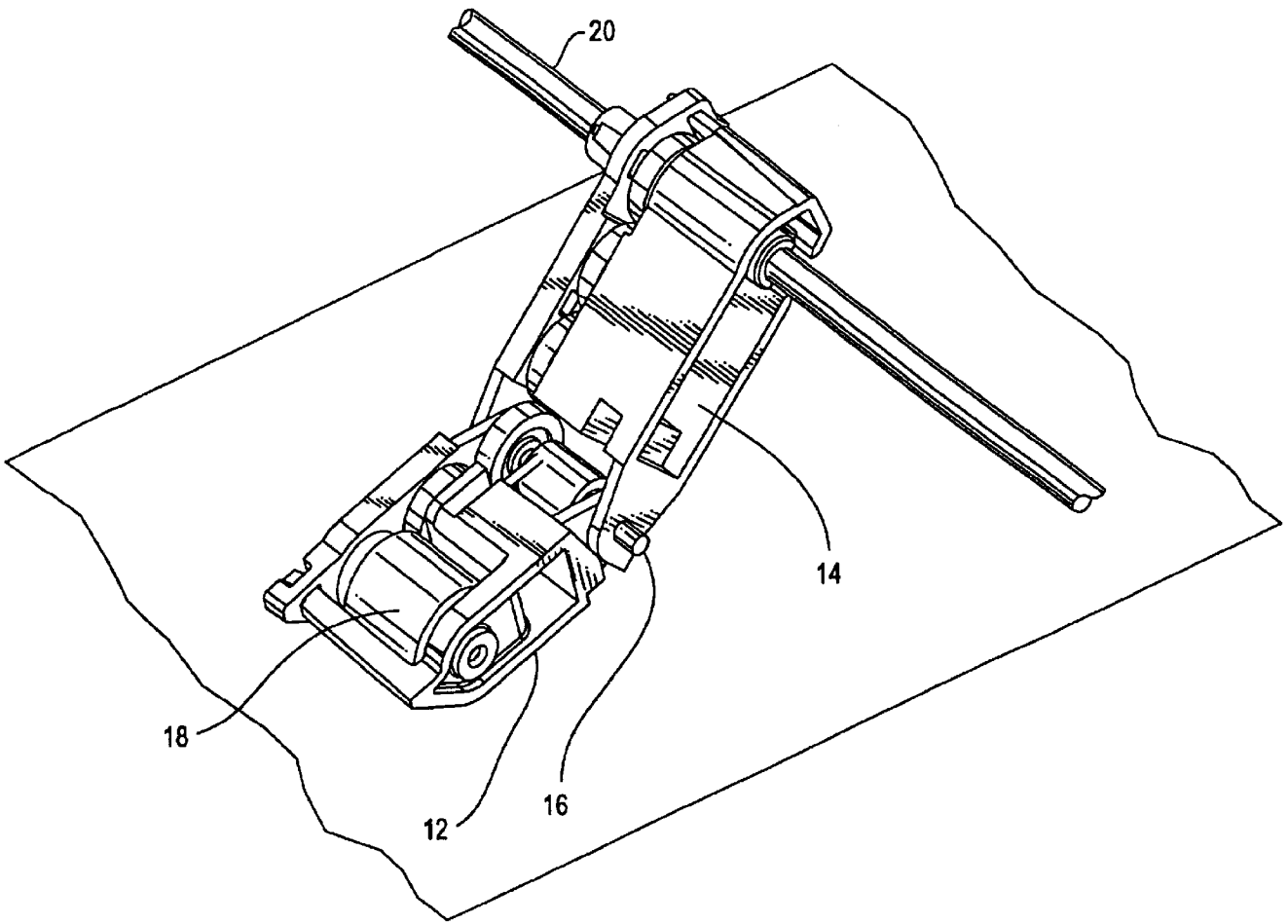
FIG. 4 is a perspective view of the pick arm shown in FIG. 3.

As shown in FIG. 3, the second arm section 14 will be caused to rotate in an anti clockwise direction about pivot point 20. The first end 12*a* of the first arm section 12 will rotate in a clockwise direction about pivot 16. This will result in the media roller 18 moving from a first position A to a second position B. As is evident from FIG. 3, the second position B is distal from the first position A in a direction away from the separation wall 26. Thus it will be appreciated that the movement of the pick arm 10 is such as to increase the distance between the media roller 18 and the separation wall 26. As explained previously, the greater the distance between the media roller 18 and the separation wall 26 the less the buckle/curl force required to buckle/curl the sheet up the separation wall 26. Hence, it will be appreciated that the resistant force RF is reduced. Due to the reduction of the resistant force RF, as shown in FIG. 5, the torque T will be sufficient to drive the sheet up the separation wall 26. After the media is moved up the separation wall 26, the resistant force RF now consists of the sheet-to-sheet friction and the frictional force between the media and the separation wall 26 under the normal force generated by the media going through the bend. This resistant force is lower than that of the initial force required to buckle/curl the media up the separation wall 20 and hence the pick arm 10 straightens.

From the above it will be appreciated that the geometry of the pick arm 10 is such as to enable it to automatically compensate for increased stiffness of the sheet or high coefficients of friction between the adjacent sheets. The pick arm 10 is able to adjust the positioning of the media roller 18 to compensate for such conditions by simply moving the media roller 18 away from the separation wall 26. The pick arm 10 returns to its first position, where the media roller 18 is located adjacent the separation wall 26, after each sheet has been driven up the separation wall.

When the media roller 18 moves away from the separation wall 26 due to relative rotational movement of the pick arm 10, the spring is further compressed. The normal force N will thus increase and is proportional to the amount of compression and the spring constant. By utilising a spring with low spring constant it is possible to reduce the increase of the normal force NF. This helps to reduce the increase in the resistant force RF due to the increase in the normal force NF, and by keeping this rate lower than that of the rate by which the buckling force is reduced due to increased roller to wall distance, the objective of reducing nett resistant force RF is achieved.

The amount of movement required by the media roller 18 (i.e. the distance between point A and B) is variable as it is dependent on the resistant force RF which is media type dependent.

From the above it will be appreciated that the present invention provides a simple but yet effective method of ensuring that media of different stiffness and coefficients of friction can be reliably picked by a pick arm. No additional motor is required to change the angle of the separation wall or the positioning of the media roller and thus no additional hardware is required. The components of the apparatus are simple to manufacture and assemble and thus there is no significant increase in costs. Thus, the invention is particularly advantageous.

The embodiment has been described by way of example only and modifications within the spirit and scope of the invention are envisaged.

What is claimed is:

1. An auto compliant pick arm for picking a media from a media stack, said pick arm including a first arm section and a second arm section which are pivotally connected together, each of said first and second arm sections having first and second ends, a media roller attached to said first end of said first arm section, said second end of said second arm section being arranged for attachment to drive means configured to apply a torque to said pick arm and wherein when said applied torque is insufficient to enable said pick arm to pick up a media and drive it up a separation wall, said media roller is arranged to automatically move from a first position to a second position, said second position being located distal from said first position in a direction away from said separation wall.

2. An auto compliant pick arm according to claim 1 wherein in said second position the force necessary to pick up said media and drive it up said separation wall is reduced when compared to the force when the media roller is located in the first position.

3. An auto compliant pick arm according to claim 1 wherein when said applied torque is insufficient to enable said pick arm to pick up said media, said first and second arm sections of the pick arm are caused to rotate so as to move the media roller away from said separation wall.

4. An auto compliant pick arm according to claim 3 wherein the first arm section is caused to rotate about the pivotal connection between the second end of the first arm section and the first end of the second arm section and the second arm section is arranged to rotate about the connection between its second end portion and a fixed pivot.

5. An auto compliant pick arm according to claim 4 wherein the fixed pivot includes a rod on which the second end of the second arm section is mounted.

6. An auto compliant pick arm according to claim 4 or claim 5 wherein the first and second arm sections are arranged to rotate in opposite directions.

7. An auto compliant pick arm according to claim 6 wherein the first arm section is arranged to rotate in a clockwise direction and the second arm section is arranged to rotate in an anticlockwise direction.

8. An auto compliant pick arm according to claim 1 wherein the pivotal connection between the first and second arm sections is spring biased.

9. An auto compliant pick arm according to claim 1 wherein the first and second arm sections each have an elongate axis and in the first position said axes are substantially coplanar or extend substantially parallel to each other.

10. An auto compliant pick arm according to claim 1 wherein the location of the second position relative to the separation wall is variable and is dependent on the media being picked.

11. An auto compliant pick arm according to claim 1 wherein the location of the second position relative to the separation wall is variable and is dependent on the media being picked.

12. An auto compliant pick arm according to claim 1 wherein a normal force applied by the media roller remains substantially constant or only increases marginally during use.

13. An auto compliant pick arm according to claim 1 wherein during use the normal force applied by the media roller to the media remains substantially constant.

* * * * *